United States Patent [19]

Green

[11] Patent Number: 4,900,613

[45] Date of Patent: Feb. 13, 1990

[54] COMFORTABLE FABRICS OF HIGH DURABILITY

[75] Inventor: James R. Green, Hockessin, Del.

[73] Assignee: E. I. Du Pont de Nemours and Co., Wilmington, Del.

[21] Appl. No.: 343,391

[22] Filed: Apr. 28, 1989

Related U.S. Application Data

[63] Continuation-in-part of Ser. No. 93,490, Sep. 4, 1987, abandoned, and a continuation-in-part of Ser. No. 273,716, Nov. 7, 1988.

[51] Int. Cl.[4] ..... D03D 25/00

[52] U.S. Cl. ..... 428/225; 428/257; 428/258; 428/259

[58] Field of Search ..... 428/257, 258, 259, 225

[56] References Cited

U.S. PATENT DOCUMENTS

| | | | |
|---|---|---|---|
| 4,120,914 | 10/1978 | Behnke et al. | 260/857 TW |
| 4,198,494 | 4/1980 | Burckel | 525/432 |
| 4,368,234 | 1/1983 | Palmer et al. | 428/259 |
| 4,497,167 | 2/1985 | Nakahara et al. | 57/328 |
| 4,651,514 | 3/1987 | Collett | 57/227 |
| 4,652,488 | 3/1987 | Willemsen et al. | 428/902 |

OTHER PUBLICATIONS

"Multi-Component Yarns of Medium Count for Special Fields of Application," Gsteu, Melliand Textileberichte-International Textile Reports (Eng. Edition, pp. 192-203 (Mar., 1986).

"Evaluation of Cotton/Kevlon ® Blends", Rhodes and Graham, Jr., 49 Textile Research Journal, pp. 28-33 (Jan. 1979).

*Primary Examiner*—James J. Bell

[57] ABSTRACT

Woven fabrics from blends of high and low modulus fibers provide comfort plus high durability to hard surface abrasion.

21 Claims, 2 Drawing Sheets

COMFORTABLE FABRICS OF HIGH DURABILITY

RELATED APPLICATION

This application is a continuation-in-part of U.S. application Ser. No. 07/093,490 filed Sept. 4, 1987, now abandoned and U.S. application Ser. No. 07/272,716 filed Nov. 7, 1988.

DESCRIPTION

1. Technical Field

This invention relates to highly durable fabrics which have good aesthetics, and are suitable for making comfortable garments which have a long wear life. The fabrics are made from blends of high and low modulus organic fibers.

2. Background

Fabrics made entirely from high modulus fibers (greater than 200 g/dtex) are useful for garments where durability is an important factor Their abrasion resistance, when rubbed against a hard surface, is relatively high compared to fabrics made from low modulus fibers (less than 100 g/dtex) However, fabrics made from high modulus fibers are substantially inferior in aesthetic quality and comfort to fabrics made from low modulus fibers In garments, it is desirable to have both the aesthetic quality and comfort of fabrics of low modulus fibers, such as cotton, and the durability of fabrics of high modulus fibers, such as poly(p-phenylene terephthalamide) (PPD-T).

Performance in abrasion tests is usually a good indication of expected wear life. Fabrics with high abrasion resistance against hard surfaces and good aesthetics would be useful for many types of apparel, in steel mills and coal mines.

An example of a currently available fabric of discrete fibers which is both comfortable and durable is a 3×1 twill fabric containing 70% cotton, 15% nylon and 15% polyester. It has a Specific Wyzenbeek Abrasion Resistance (as defined below) of about 1–1.5 cycles/g/m$^2$.

Cotton fabrics have low abrasion resistance to rubbing against hard from relatively high. However, prior art fabrics made blends of PPD-T and cotton have only slightly higher abrasion resistance than all cotton fabrics and substantially lower abrasion resistance than all PPD-T farbics.

Increased abrasion resistance has been achieved in garments through use of a thermoplastic patch attached to areas of severe wear However, the patch has high fabric stiffness, poor moisture permeability and is susceptible to detachment

DRAWINGS

SUMMARY OF THE INVENTION

Figure 1A:
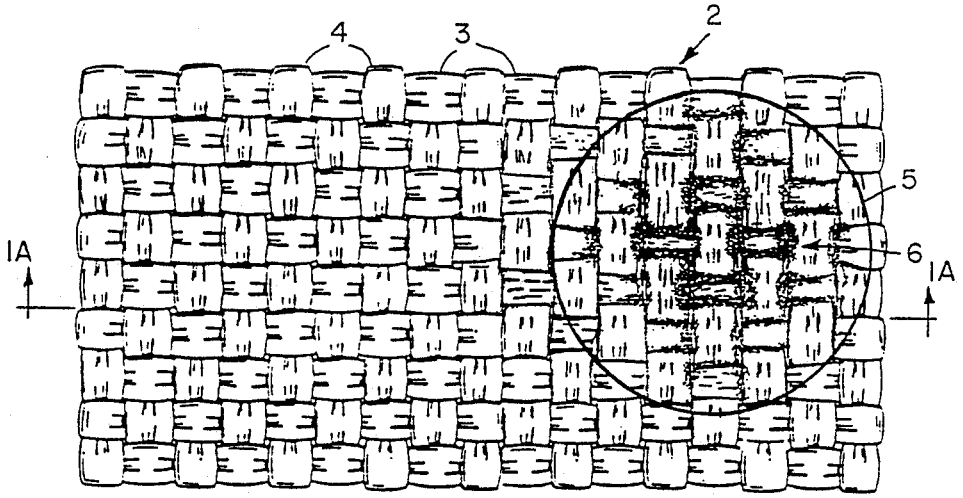
FIGS. 1A and 1B are schematic diagrams of top and section views, respectively, of a fabric of the invention The encircled area in the top view represents an abraded area of the fabric.

A woven fabric made from yarns of high modulus and low modulus discrete organic staple fibers and having good textile aesthetics and exceptionally high durability has now been discovered.

The fabric contains at least 15% of staple fibers having a modulus greater than 200 g/dtex in the warp yarns. From 30–92% of the fabric consists of staple fibers having a modulus of less than 100 g/dtex, said fabric having a fabric tightness of at least 1.0, and a fiber tightness above 1.0. Preferred fabrics have a Specific Wyzenbeek Abrasion Resistance on at least one face of the fabric that is at least 25%, and preferably, at least 50% greater than the Specific Wyzenbeek Abrasion Resistance on the same face of a greige fabric of the same basis weight and construction made from 100% of the high modulus staple fibers. In certain preferred fabrics, the Specific Wyzenbeek Abrasion Resistance on at least one face, preferably both faces of the fabric, is greater than 5 cycles/g/m$^2$, preferably greater than 10 cycles/g/m$^2$. The percentage of high modulus fibers in the warp yarns should be at least 15% in order to obtain the high abrasion resistance and should be from 8–70% of the total fabric. Greater amounts would cause the fabric to be stiff and harsh and lack good textile aesthetics. It is preferred that the warp yarn contains at least 30% of low modulus staple fiber. High modulus fibers may be present or absent in the fill yarns of the woven fabric. In certain preferred fabrics, the warp yarn is comprised of an intimate blend of crimped staple fibers. The percentage of staple fibers in the fabric, unless otherwise indicated, refers to percentage by weight.

DETAILED DESCRIPTION OF THE INVENTION

In one method of practicing the invention, the warp yarns from which the fabrics are woven are sheath/core yarns of crimped staple fibers in which the high modulus fibers form the core and are locked in place by low modulus synthetic fibers comprising the sheath. Autoclaving the greige fabric can provide the shrinkage needed to obtain fabric having a Specific Wyzenbeek Abrasion Resistance at least 25% greater than the Specific Wyzenbeek Abrasion Resistance on the same face of a greige fabric of the same construction and basis weight made from 100% of the high modulus staple fibers. Autoclaving can be performed by exposing rolls of the greige fabric to high pressure steam in an autoclave. The time and temperature of the exposure are those known in the art to induce relaxation or crystallization of synthetic fibers such as to cause fabric shrinkage of about 5%. This process is effective as a shrinkage process if the fabric to be treated contains at least 30% of heat-shrinkable low modulus fibers such as nylon, polyester or other synthetic fiber.

In another mode of the invention, flame-retarding of woven fabric of conventionally spun yarns containing the requisite amount of high modulus fiber, i.e., at least 15% in the warp yarns, and at least 30% of cotton can achieve sufficient shrinkage to yield fabrics of the invention. The fabric is flame-retarded with tetrakis(hydroxymethyl) phosphonium chloride urea condensate and cured. In this process, the greige fabric is scoured, dried, and pulled through an aqueous solution wherein the phosphonium compound is imbibed into the cotton. The fabric is then substantially dried (less than about 15% water content by weight of fabric) and then exposed to liquid or gaseous ammonia as is well-known in the art. Generally, the fabric is then rinsed and dried while held under tension in the warp direction but is unrestrained in the fill direction. The cotton fibers in the fabric become greatly swollen when wet with the phosphonium compound and then undergo shrinkage when they are at least partially deswollen when they are dried. The flame-retarded fabric is finally subjected to a conventional compressive shrinkage treatment. In the case of fabrics which are treated with flame-retarding agents or other materials which permanently change the weight of the fabrics, the staple fiber composition by weight of the yarns and fabrics is determined after the fabrics are treated, rather than before, for the purpose of determining whether the fabrics are fabrics of the invention.

Still another way of preparing products of the invention is to mercerize a woven fabric having warp yarns spun from at least 15% high modulus fiber with at least 30% of cotton in the fabric to achieve the desired shrinkage and to obtain products of the invention In general, mercerization is performed by pulling the greige fabric through a caustic solution, e.g., from 10 to 24% caustic at temperatures up to about 82° C.(180° F.) for short periods, e.g., 30 seconds. Applicant has found double mercerization to give the desired result. Care should be taken to limit exposure time of the fabric to the caustic to avoid degradation of the high modulus fiber. The fabric is then rinsed, neutralized with acetic acid and dried while tensioned in the warp direction but free to relax in the fill direction. The cotton fibers in the fabric become greatly swollen when wet with the caustic solution and then undergo shrinkage when they are deswollen upon drying It should be noted that the mercerization treatment may change the weight of fibers in the greige fabric enough to change the staple fiber composition by weight of the treated fabric After the mercerization treatment or treatments the fabric may also be subjected to a conventional compressive shrinkage treatment.

A single mercerization treatment followed by a flame-retardant treatment can also be used to give the desired result.

Example 10 below uses multiple wash cycles of fabrics of sheath/core yarns as a method of obtaining the requisite amount of shrinkage.

In each of the aforementioned procedures, the low modulus fiber shrinks within the woven fabric to bind or lock the high modulus fiber in place giving the fabric abrasion resistance as described below. When the fabric contains a high modulus fiber which is shrinkable and retains its high modulus properties after shrinkage, the desired result can be achieved by shrinking the high modulus fiber in addition to or in place of shrinking the low modulus fiber. Regardless of the manner of preparation, the fabric to be treated should have a fabric tightness greater than 1.0 and a fiber tightness of less than 1.0. The shrinking treatment must be sufficient to raise the fiber tightness above 1.0 measured as described below in order to obtain the abrasion resistant fabrics of the present invention.

The high modulus staple fibers and low modulus staple fibers are textile fibers having a linear density suitable for wearing apparel, i.e., less than 10 decitex per fiber, preferably less than 5 decitex per fiber. Still more preferred are fibers that have a linear density of from about 1 to about 3 decitex per fiber. Crimped fibers are particularly good for textile aesthetics and processibility. The fabric is made from discrete staple fibers, i.e., staple fibers that are not fused or bonded to each other.

The process for making the fabric comprises the steps of weaving the fabric from warp yarns containing at least 15% staple fibers having a modulus of greater than 200 g/dtex and with 30–92% of the staple fibers of the fabric having a modulus of less than 100 g/dtex, and treating the fabric to achieve the required degree of fabric and fiber tightness.

It is believed that the mechanism for the unexpectedly high abrasion resistance of the fabric of the invention made from a blend of high modulus and low modulus fibers is that the high modulus fibers are held tightly in multiple places within the fabric. As the fabric is abraded, fibers that break (including high modulus fibers) will fall out of the fabric less readily because they tend to be still locked in place. Instead of dropping out of the fabric, they remain as tufts which help resist further abrasion of the fabric. This creates a buffer of broken ends of stiff high modulus fibers between the abrasive and the unbroken fibers of the fabric. Since the high modulus fibers are difficult to abrade, this buffer greatly reduces further damage If the high modulus fibers are not locked in place, abrasion of the fabric would likely cause the broken fibers to drop out of the fabric and to no longer protect the remaining fabric.

Figure 1B:
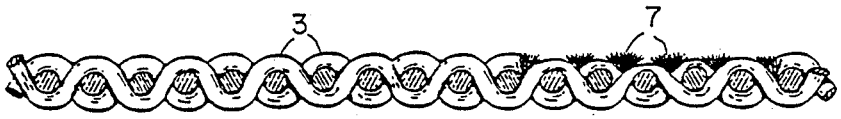

Reference to the Figures will assist in understanding what is believed to be the mechanism of behavior. Two views of fabrics of the invention are depicted schematically. FIG. 1A, fabric 2, a plain woven fabric of warp yarns 3 and fill yarns 4 is shown. Encircled area 5 represents an area where the fabric has been severely abraded Roughened zones 6 represent brush-like tufts comprising broken ends of the fibers locked in place within the fabric. FIG. 1B is a section taken on line 1A—1A of FIG. 1A and shows the warp yarns 3 as continuous and tufts 7 representing broken ends of fibers, including the stiff high modulus fibers.

Figure 2A:
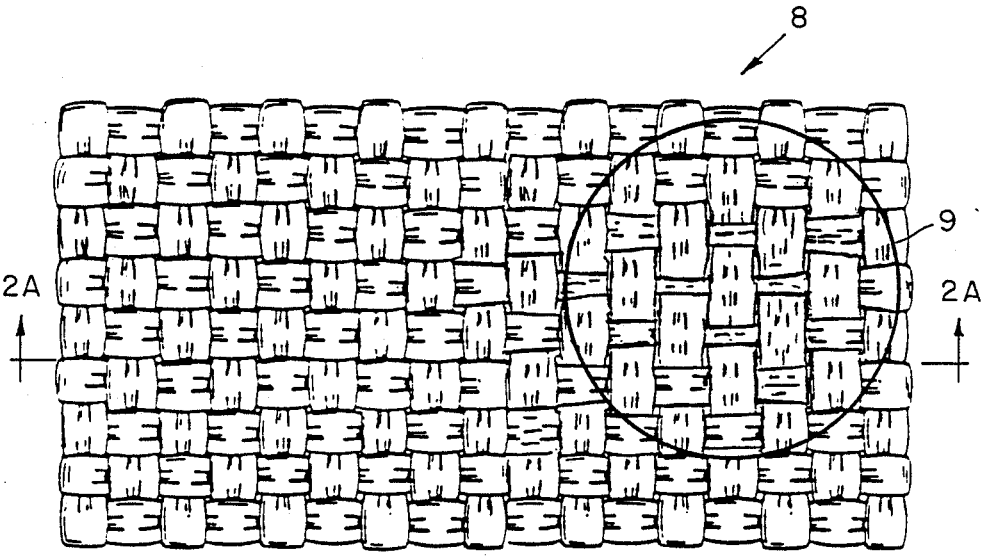
FIGS. 2A and 2B are schematic diagrams of top and section views, respectively, of a greige fabric corresponding in construction and basis weight to the fabric of FIGS. 1A and 1B. The encircled area in the top view represents an abraded area of the fabric.
Figure 2B:
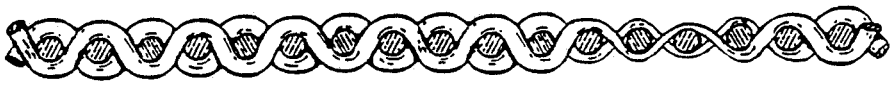

FIG. 2A schematically depicts a greige fabric 8 of the same basis weight and construction as the fabric of FIG. 1A but tells a different story with respect to the encircled abraded area 9. Few, if any, broken ends of fiber, including high modulus fiber, are locked in place. Instead, the broken fibers have dropped out of the fabric resulting in a fabric worn thin in the abraded area as shown in FIG. 2B which is a section taken on line 2A—2A of FIG. 2A. Continued abrasion will rapidly wear through the fabric.

Because of the presence of the brush-like tufts of broken ends of fibers, the fabrics of the invention are markedly less permeable to the passage of air after they have been abraded than they are before they have been abraded. This is in contrast to other fabrics of the same basis weight and construction (such as the greige fabrics from which the fabrics of the invention are prepared), which exhibit a smaller decrease in permeability or become more permeable to the passage of air when they are abraded. The air permeability of fabric before and after abrasion is employed as a measure of the degree to which the fibers in a fabric are held tightly in the determination of the Fiber Tightness described below.

The fibers can be spun into yarns by a number of different spinning methods, including but not limited to ring spinning, air-jet spinning and friction spinning.

An exemplary high moduls fiber for use in present invention is poly(p-phenylene terephthalamide) (PPD-T) staple fiber. This fiber can be prepared as described in U.S. Pat. No. 3,767,756 and is commercially available.

Other organic staple fibers having a modulus of at least 200 g/decitex may be used including, but not limited to, the following:

High-modulus fiber of a copolymer of terephthalic acid with a mixture of diamines comprising 3,4'-diaminodiphenyl ether and p-phenylenediamine as disclosed in U.S. Pat. No. 4,075,172.

High-modulus fiber of high molecular weight polyethylene, solution spun to form a gel fiber and subsequently stretched, as disclosed in U.S. Pat. Nos. 4,413,110 and 4,430,383.

High-modulus, ultra-high tenacity fiber of polyvinyl alcohol having a degree of polymerization of at least 1500, made by the dry-jet wet spinning process, as disclosed in U.S. Pat. No. 4,603,083.

High modulus fiber spun from an anisotropic melt-forming polyester or copolyester, and heat-treated after spinning, of the class disclosed in U.S. Pat. Nos. 4,161,470, 4,118,372 and 4,183,895. An example of such a polymer is the copolyester of equimolar amounts of p-hydroxybenzoic acid and 6-hydroxy-2-naphthoic acid.

The term "organic staple fibers" as used herein, means staple fibers of polymers containing both carbon and hydrogen and which may also contain other elements such as oxygen and nitrogen An exemplary low modulus fiber for use in the present invention when mercerization or flame-retarding is employed to achieve shrinkage, is cotton. Other cellulosic fibers, both natural and synthetic, such as flax and rayon, are also suitable but variations in treatment may be required to achieve shrinkage as will be understood by those skilled in the art. Wool fibers may be used. Many low modulus fibers of synthetic origin, such as fibers of 66 and 6 nylon, polyethylene terephthalate and other polyesters, polyacrylonitrile and other acrylic fibers, polybenzimidazole, and poly(m-phenylene isophthalamide) (MPD-I) are also suitable for certain yarn constructions and fabric treatment such as autoclave shrinking. Low modulus polyvinyl alcohol fibers, as disclosed in U.S. Pat. No. 2,169,250, may be used.

Compressive shrinkage is a treatment which is frequently applied commercially to cotton abrics as well as to other fabrics, normally for the purpose of minimizing the residual shrinkage of the fabrics, and may be employed with fabrics of this invention. This process is described in various references, such as in "Textiles: Fiber to Fabric" by Dr. Bernard P. Corbman, pages 183–184, (McGraw-Hill Book Company, New York, N.Y., 1975). In the compressive shrinkage process, the fabric is dampened with pure water and live steam, gripped along its selvage with stretching action, and held firmly against a heavy blanket under controlled tension, the tension of the blanket then being relaxed to the desired extent, forcing the fabric to comply and to shrink uniformly, after which the fabric is carried around a heated drum while drying. As applied to cotton-containing fabrics of this invention, compressive shrinkage would normally be the last step, following flame-retarding or mercerizing.

During the preparation of the fabrics of the invention durable press resins may be applied to the fabric. Many other conventional fabric treatments may also be carried out upon the fabrics. It is preferred that additives incorporated in the fabric are in the range of 0–5 wt. % of the weight of the fabric.

TEST METHODS AND DETERMINATIONS

Preparation of Fabrics For Tests and Determinations

All fabric tests and measurements for determinations, including determination of fabric basis weight and construction (ends vs. picks count) for both greige and finished fabrics, are preceded by subjecting the fabrics which are to be tested or measured to five wash/dry cycles. Each wash/dry cycle consists of washing the fabric in a conventional home washing machine in a 12 pH aqueous solution of sodium hydroxide at 57° C. (135° F.) with 14 minutes of agitation followed by rinsing the fabric at 37° C. (100° F.) and drying in a conventional tumble dryer after each washing to maximum dryness at a final (maximum) temperature of 71° C. (160° F.), usually requiring a drying time of about 30 minutes. Contamination prior to testing of the samples which have been subjected to the five wash/dry cycles, e.g. by exposure to foreign materials, is carefully avoided. To avoid changes in the fabric structure resulting from the passage of time, tests of and measurements upon fabric samples are carried out soon, i.e. within a few days, after they are subjected to the five wash/dry cycles.

Determination of Wyzenbeek Abrasion Test Values

The Wyzenbeek Abrasion Test, in the modified form employed herein, is a severe abrasion test for the testing of fabrics, at least some of which are anticipated to be highly abrasion resistant. Briefly described, it comprises a test employing an apparatus in which a semi-circular drum is adapted to oscillate through an arc of 76 mm, first in one direction and then in the reverse direction, with two flattened rods being mounted on the surface of the drum parallel to each other and the axis of rotation of the drum. An abrasive sheet is clamped over the surface of the drum, centered over the flattened rods. The apparatus is provided with clamps adapted to hold a fabric sample in fixed position above the abrasive sheet and in contact with it under a predetermined tension. The drum, with the abrasive sheet mounted upon it above the flattened rods to localize the abrasive action, is rotated back and forth under the fabric sample, rubbing it against the abrasive sheet (each double rub over the abrasive sheet, once in each direction, being one cycle), until the fabric fails, the number of cycles of rotation to fabric failure being reported as the abrasion test value.

While the above paragraph is a brief description of the test, the actual test procedure relied upon herein is the procedure as described in *RESEARCH DISCLOSURE,* October, 1988, Publication Item No. 29405, "Modified Wyznbeek Abrasion Test", pp. 707–9; except that the fabric samples are prepared for testing by subjecting them to the five wash/dry cycles as described above; and that the number of cycles to failure is reported as the number of cycles to which the fabric sample is exposed until it is observed that a hole appears in the fabric sample from having broken a warp and fill yarn at an intersection. Also, when testing samples which stretch when they are abraded, the machine is stopped and the tension is adjusted to prevent the tension arms from dropping more than 2 cm from the original horizontal setting. The average number of cycles to failure determined in this way is used to determine the Specific Wyzenbeek Abrasion Resistance.

Specific Wyzenbeek Abrasion Resistance

After the average number of cycles to failure is calculated as described above, a further calculation is made by dividing the average number of cycles to failure by the basis weight of the fabric in g/m$^2$. This value, the average number of cycles to failure divided by the basis weight of the fabric in g/m$^2$, is designated as the "Specific Wyzenbeek Abrasion Resistance". In the case of fabrics having an unsymmetrical construction, a separate calculation is made for each face.

Determination of Fabric Tightness

The degree to which yarns are jammed together within a woven fabric is defined as "fabric tightness" and is determined and calculated as described in *RESEARCH DISCLOSURE,* October, 1988, Publication Item No. 29498, "Calculation of Fabric Tightness Factor", pp. 833–6 (the word "factor" being omitted herein). In determining fabric tightness, it should be noted that the fiber densities used in the calculations should be the densities of the fibers as they are in the fabric after any fabric treatments and after the five wash/dry cycles; e.g., for cotton fibers in flame-retarded fabrics, the density value used should be not only after the flame-retarding treatment but also after the five wash/dry cycles. The linear density of a yarn in decitex or cotton count is determined by removing the yarn from the washed fabric, hand stretching the yarn to obtain the length of the yarn without weave crimp, and then weighing that length to determine an approximate linear density; then loading the yarn to 0.11 g/dtex and determining its length under the load. The length determined in this way is used together with the weight of the same length of yarn to calculate the linear density used in the formula for fabric tightness.

Determination of Fiber Tightness

The degree to which fibers are held tightly within a woven fabric and resist pull out when broken is defined as "fiber tightness" and is determined as follows.

Samples of each fabric are abraded by rubbing them along the fill direction using the Wyzenbeek Abrasion Tester described in the test section above entitled "*Determination of Wyzenbeek Abrasion Test Values*" except that the criterion for the number of cycles to failure is the number of cycles to which the fabric sample is exposed until it is observed that either a hole appears in the fabric sample from having broken a warp and fill yarn at an intersection or it is observed that enough warp yarns have been broken to expose 0.32 cm (0.125 in) of fill yarn, whichever occurs first. In determining the fiber tightness, samples of fabrics of unsymmetrical construction are always abraded on the side of the fabric with the maximum warp float (the number of fill yarns the warp yarn passes over between interlacings). The side of the fabric with the maximum warp float is designated as the "long float side", and the other side is designated as the "short float side". A preliminary determination is first made for each fabric of how many abrasion cycles are required to abrade the fabric to failure. Three samples of each fabric are abraded to failure, and the number of abrasion cycles required to abrade the fabric to failure is determined by averaging the number of cycles to failure for these three samples.

To determine the fiber tightness, fabric test samples are then abraded to 50% of the number of abrasion cycles required to abrade the fabric to failure. These abraded fabric samples are then cleaned by holding the center of the abraded area horizontally for 28 seconds across a vertical stream of aerated water 1.3 cm in diameter flowing at a rate of 10 liters/min at a temperature of 6° C., alternating from front to back every 7 seconds. The water is aerated by passing it through a fine metal screen on the end of the faucet. Test specimens are hung vertically in an oven at 90° C. and dried half an hour. Since fabrics are stretched when abraded, they are removed from the oven and allowed to relax at least 24 hrs to stabilize them.

Air permeability is then measured at the center of the most highly abraded area (the midpoint between where the aluminum rods support the fabric when the drum is at the top of its stroke and at equal distance from the sides of the specimen) and on both ends of the specimen outside of the abraded area following the procedure described in ASTM Designation D737-75 (reapproved 1980), "Standard Test Method for Air Permeability of Textile Fabrics", using the optional high pressure machine fitted with a circular orifice 2.86 cm (1.13 in) in diameter exposing 6.45 cm$^2$ (1 in$^2$) area of fabric. A thin felt is used on the pressure plates to eliminate air leakage across the face of the fabrics. Tests on the same specimen are run at a pressure of 12.7 mm of water (0.5 in), across the fabric surfaces. Since only relative values are required and not actual air permeability values, the numbers recorded for the level of oil in the vertical monometer in the machine are not converted to air permeability values. The ratio is calculated of the average level of oil reached in the vertical monometer when testing outside the abraded area to the level of oil reached when testing at the center of the most highly abraded area (both measured on the same test specimen with the same nozzle). In order to avoid grossly nonuniform test specimens, specimens are discarded if the difference between the two measurements made outside the abraded area exceeds 40% of the average of the two values. The average of three specimens is designated as the Air Permeability Factor.

The product of Air Permeability Factor and the warp float divided by 3.5 is calculated to two decimal places and is designated as the "fiber tightness". Meaningful values can only be obtained on fabrics having warp float lengths of four or less. The number of fill yarns the warp yarn passes over between interlacings is given below for various conventional fabric styles.

| Style | Maximum Warp Float |
|---|---|
| Plain weave | 1 |
| 3 × 1 twill | 3 |
| Sateen | 3 |
| 2 × 1 twill | 2 |
| 5 harness 4 × 1 satin | 4 |

As an example of the calculation of fiber tightness, a greige 100% cotton plain-weave fabric of ringspun yarns was made by substantially the same procedure used to make the greige fabric of Example 4 below, except that slivers of 100% of the pima cotton were used. The two-ply ring-spun yarns had a linear density of 583 dtex (nominal 20/2 cotton count), and the greige 100% cotton fabric had a construction of 20 ends per cm x 19 picks per cm and a basis weight of 278 g/m$^2$. When tested in accordance with the method for Determination of Fiber Tightness above, three samples of the fabric were abraded to failure after an average of 50 abrasion cycles in the preliminary determination. Three additional samples of the fabric were each abraded to 25 cycles (50% of the average number of cycles to failure), rinsed, and dried as described above. For each fabric sample abraded to 25 cycles the air permeability was then measured at the center of the most highly abraded area and on both ends (Ends A and B in the table below) of the sample outside of the abraded area. The data obtained in determining the Air Permeability Factor were as follows:

| Sample No. | Oil Rise (cm) Unabraded Areas End A | End B | Average | Oil Rise Abraded Area | Ratio Unabraded/Abraded |
|---|---|---|---|---|---|
| 1 | 18.8 | 17.8 | 18.3 | 19.05 | 18.3/19.05 = 0.96 |
| 2 | 20.6 | 21.6 | 21.1 | 21.6 | 21.1/21.6 = 0.98 |
| 3 | 20.3 | 20.6 | 20.45 | 20.1 | 20.45/20.1 = 1.02 |
| | | Air Permeability Factor = | | | Average = 0.99 |

For this plain-weave 100% cotton fabric the fiber tightness is accordingly:

$$\text{Air Permeability Factor} \times \text{warp float}/3.5 = 0.99 \times 1/3.5 = 0.28$$

In the fabrics of the invention, the fiber tightness is 1.01 or more.

For the preferred, most highly durable fabrics of the present invention, it has also been found that the Wyzenbeek abrasion resistance itself is a sensitive parameter which measures whether the high modulus fibers in a given fabric are locked in place in the given fabric. This can be determined by measuring the value of the Specific Wyzenbeek Abrasion Resistance. The given fabric is a preferred fabric of the invention if the Specific Wyzenbeek Abrasion is at least 5 cycles/g/m$^2$, preferably 10 cycles/g/m$^2$.

By a separate criterion, the given fabric is a preferred fabric of the invention if the Wyzenbeek abrasion resistance value of the given fabric on at least one face of the given fabric is at least 25% greater than the Wyzenbeek abrasion resistance on the same face of a comparison greige fabric of the same basis weight and construction made from 100% of the high modulus fibers. The comparison fabric of 100% the high modulus fibers should be made of yarns having the same linear density and construction as the yarns from which the given fabric is woven (e.g., they should be sheath/core if the yarns of given fabric are sheath/core), and the comparison fabric of 100% high modulus fibers should also have substantially the same construction and substantially the same basis weight as the given fabric. By "substantially the same construction", it is meant that the fabrics are the same style, e.g., plain weave, and that the end and pick counts are at least within about 20% of the end and pick counts of the given fabric and that the total number of ends and picks (per unit area) are within about 10% of the total number of ends and picks of the gin fabric.

By "substantially the same basis weight", it is meant that the basis weight of the comparison fabric should be at least within about 25% or so of the basis weight of the given fabric. This permits a good comparison between the given fabric and the comparison fabric of 100% high modulus fibers when the comparison is made on the basis of the Specific Wyzenbeek Abrasion Resistance.

If the given fabric contains additives and the weight of the additives is known, the comparison greige fabric of 100% high modulus fibers is prepared so that it has substantially the same basis weight of the given fabric minus the weight of the additives and so that the yarn and fabric constructions are substantially the same as the given fabric exclusive of the additives. However, in making the comparison between the fabrics on the basis of the Wyzenbeek abrasion test values divided by the fabric basis weights, the basis weight of the given fabric including the additives is used, even though this results in lower number of cycles/g/m$^2$ for the given fabric.

If the given fabric contains additives and the weight of the additives is not known, a comparison greige fabric of 100% high modulus fibers having substantially the same construction and basis weight as the given fabric (inclusive of its additives) is constructed from yarns of the high modulus fiber which have a sufficiently high yarn linear density to provide the same basis weight as the given fabric.

EXAMPLES

Example 1

A highly durable fabric of the present invention was prepared by employing a flame-retarding swelling agent to treat a plain-weave fabric woven from a yarn spun from a two-component intimate blend of 50 wt. % poly(p-phenylene terephthalamide) (PPD-T) staple fibers and 50 wt. % pima cotton on an air-jet open end spinning machine.

The PPD-T fibers used to make the spun yarn were commercially available crimped fibers having a modulus of about 515 g/dtex, a linear density of 1.65 dtex (decitex) (1.5 dpf), and a cut length of 3.8 cm (1.5 in.) (available as Type 29 "Kevlar" aramid fiber from E. I. du Pont de Nemours and Co.).

A picker blend sliver of 50 wt. % of the PPD-T fibers and 50 wt. % pima cotton having a fiber length of 3.65 cm (1-7/16 in.) was spun in a single pass through an air-jet open end spinning machine such as is generally shown and described in U.S. Pat. No. 4,497,167 to Nakahara et al. (marketed as a Type No. 801, Model No. 8100065 Murata Spinning Machine, manufactured November 1981, by Murata K.K.K. of Kyoto, Japan). The machine settings are listed in Table 2. The sliver had a linear density of 2.5 g/m (35 grains/yd). The spun yarn so formed had a linear density of about 300 dtex (nominal 20/1 cotton count). The spun yarn was then "S" ply-twisted 3.5 tpc (turns per cm) (9 tpi [turns per inch]) to make a two-ply spun yarn having a linear density of 600 dtex (nominal 20/2 cotton count; 546 denier).

The two-ply spun yarn was woven on a shuttle loom to make a plain-weave fabric. The greige plain-weave fabric had a construction of 19 ends per cm x 19 picks per cm (49 ends per in. x 49 picks per in.), a basis weight of 257 g/m$^2$ (7.6 oz./yd$^2$), a fabric tightness of 1.08, and a fiber tightness of 0.34. Its Specific Wyzenbeek Abrasion Resistance was 1.5 cycles/g/m$^2$.

A quantity of the greige plain-weave fabric prepared as described above, as taken from the loom (unwashed), was scoured at 80°-85° C., dyed at the boil, and the dyed fabric was then treated with an aqueous solution of a 2:1 mol ratio tetrakis(hydroxymethyl)phosphonium chloride (THPC):urea condensate (a flame-retarding agent available as "Proban CC" from Albright & Wilson Inc., P.O. Box 26229, Richmond, Va.) followed by a curing process in which gaseous ammonia was passed through the moist fabric (containing about 10 to 20 wt. % water) which had been treated with the THPC:urea condensate; after which the fabric was rinsed and dried. During this treatment the fabric was unrestrained in the fill direction but was taut in the warp direction as the fabric was pulled through the solution of flae-retarding agent. The cotton fibers in the fabric became greatly swollen while the fabric was in contact with the solution. This treatment was carried out in a manner such that the pick-up of the THPC: urea condensate was 20 wt. %, based on the weight of the cotton in the 50% PPD-T/50% cotton fabric. After this treatment, the fabric had a fiber content of 45 wt. % PPD-T staple fibers and 55 wt. % flame-retarded cotton fibers.

The flame-retarded fabric was then subjected to a conventional commercial compressive shrinkage treatment.

The finished (flame-retarded, compressively shrunk) fabric had a construction of 20 ends per cm x 20 picks per cm (50 ends per in. x 51 picks per in.), a basis weight of 298 g/m$^2$ (8.8 oz/yd2), a fabric tightness of 1.18, and a fiber tightness of 6.67. Its Specific Wyzenbeek Abrasion Resistance was 27.6 cycles/g/m$^2$. After the finished fabric had been washed even once, it had a relatively soft hand, with a dry, pleasant feel and good wrinkle recovery approaching that of an all-cotton fabric.

The results for fabric tightness, fiber tightness, and Specific Wyzenbeek Abrasion Resistance for the finished fabric (fabric of the invention) of Example 1 as well as the finished fabrics of the other examples below are listed in Table 1.

A greige plain-weave fabric of 100% PPD-T fibers made in the same way as the greige plain-weave fabric of Example 1 and having the same basis weight and construction had a Specific Wyzenbeek Abrasion Resistance of only 4.6. cycles/g/m$^2$. It had a stiff, harsh hand, even after repeated washings. When the fabric was wrinkled it had almost no recovery, a fabric behavior which is typical of fabrics made of fibers of such high modulus.

Example 2

A highly durable fabric of the present invention was prepared by double mercerizing a twill fabric woven from ring-spun yarns of intimate blends of PPD-T staple fibers, nylon staple fibers, and cotton.

A picker blend sliver of 25 wt. % of blue dyed PPD-T fibers having a linear density of 1.65 dtex (1.5 dpf) and a cut length of 3.8 cm (1.5 in.), 20 wt. % of polyhexamethylene adipamide (6,6-nylon) fibers having a linear density of 2.77 dtex (2.5 dpf) and a cut length of 3.8 cm (1.5 in) (available as T-420 nylon fibers from E. I. du Pont de Nemours & Co., Inc.), and 55 wt. % combed cotton having a fiber length of 3 cm (1-3/16 in) was prepared and processed by the conventional cotton system into a spun yarn having 3.6 tpc of "Z" twist (9.2 tpi) using a ring spinning frame. The yarn so made was 972 dtex (nominal 6/1 cotton count; 883 denier) singles spun yarn.

The singles yarn so formed was used as the warp on a shuttle loom in a 3×1 right hand twill construction with a singles ring spun fill yarn made from 30 wt. % of the same 6,6-nylon fibers used in the warp yarn and 70 wt. % combed cotton, the fill yarn having the same twist and linear density as the warp yarn. The greige twill fabric had a construction of 25 ends per cm x 19 picks per cm (63 ends per in x 48 picks per in.), a basis weight of 498 g/m$^2$ (14.7 oz/yd$^2$), a fabric tightness of 1.10, and a fiber tightness of 0.75. The fabric had a fiber content of 15 wt. % PPD-T staple fibers, 24 wt. % nylon staple fibers, and 61 wt. % cotton fibers. Its Specific Wyzenbeek Abrasion Resistance value on the long float (LF) face of the fabric was 1.2 cycles/g/m$^2$, abbreviated 1.2 LF cycles/g/m2, while the Specific Wyzenbeek Abrasion Resistance value on the short float (SF) face of the fabric was 1.3 cycles/g/m$^2$, abbreviated 1.3 SF cycles/g/m$^2$.

A quantity of the greige twill fabric prepared as described above, as taken from the loom (unwashed), had a width of 131 cm (51.75 in). It was scoured in hot water and dried under low tension on a tenter frame. It was then held relaxed at a width of 122 cm (48 in.) and mercerized by subjecting it to a 24% sodium hydroxide solution at 82° C. (180° F.) for about 30 seconds, rinsed in water, neutralized, and dried on hot cans. Mercerization was repeated with the sample held at a width of 114 cm (45 in.) width. It was then dyed blue on a continuous range and dried at 82°-3° C. (180°-2° F.) on hot cans. Following dyeing it was compressive shrunk. The basis weight for the finished (double mercerized, compressively shrunk) fabric was 467 g/m$^2$ (13.8 oz/yd$^2$). It had a construction of 25 ends per cm x 18 picks per cm (63 ends per in x 45 picks per in.), a fabric tightness of 1.10 and a fiber tightness of 1.34. It had a fiber content of 15 wt. % PPD-T staple fibers, 24 wt. % nylon staple fibers, and 61 wt. % cotton fibers. In the warp yarns, the corresponding percentages were 25 wt. %, 20 wt. %, and 55 wt. %. Its Specific Wyzenbeek Abrasion Resistance values were 4.4 LF and 4.4 SF cycles/g/m$^2$. The finished fabric had a soft hand.

Example 3

A highly wear-resistant fabric of the present invention was prepared as an autoclave heat-treated plain-weave fabric woven from a compound spun yarn of 51 wt. % PPD-T staple fibers and 49 wt. % poly(m-phenylene isophthalamide) (MPD-I) staple fibers made on an air-jet open end spinning machine in two passes through the machine.

The PPD-T fibers used to make the compound spun yarn were the same PPD-T fibers used in Example 1. The MPD-I fibers used to make the compound spun yarn were commercially available crystalline fibers having a linear density of 1.65 dtex (1.5 dpf) and a cut length of 3.8 cm (1.5 in.) (available as T-450 "Nomex" aramid fibers from E. I. du Pont de Nemours & Co.).

A 2.5-g/m (35 grain/yd) sliver of the PPD-T fibers was first formed and spun into yarn on the air-jet open end spinning machine used in Example 1. The yarn so spun had a linear density of 155 dtex (nominal 38 cotton count). The PPD-T spun yarn made in this first pass was then used as the core yarn in a compound yarn by passing it through the air-jet open end spinning machine again and joining it with a 2.5-g/m (35-grain/yd) sliver of the MPD-I staple fibers to form a compound singles yarn. The machine settings for both the first and second passes are listed in Table 2. The compound singles yarn so formed was a sheath-core yarn having a fasciated structure in which some of the PPD-T fibers in the PPD-T core yarn were wrapped by loose ends of PPD-T fibers and some of the MPD-I fibers in the sheath also wrapped the PPD-T core yarn. The compound singles yarn was then "S" ply-twisted 3 tpc (7.5 tpi) to make a two-ply spun yarn having a linear density of 605 dtex (nominal 20/2 cotton count; 550 denier).

The plied yarn so formed was woven on a shuttle loom into a plain weave fabric. The greige plain-weave fabric had a construction of 21 ends per cm x 20 picks per cm (53 ends per in. x 52 picks per in.), a basis weight of 277 g/m$^2$ (8.2 oz./yd$^2$), a fabric tightness of 1.13, and a fiber tightness of 0.56. Its Specific Wyzenbeek Abrasion Resistance was 4.2 cycles/g/m2.

Greige plain-weave fabric prepared as described above, as taken from the loom (unwashed), was scoured in an aqueous solution of 1% of a long-chain alcohol sulfate surface active agent and 1% tetrasodium pyrophosphate at 99° C. (210° F.) for 20 minutes followed by a 20-minute rinse in 0.5% aqueous acetic acid at 71° C. (160° F.), cold calendered, and wrapped on a tube which was then placed vertically in an autoclave. The autoclave was placed under vacuum and the fabric was then twice subjected to 20-minute exposures to steam at 122° C. (252° F.) with intervening and final 5-minute vacuum cycles. The finished (autoclaved) fabric had a construction of 20 ends per cm x 22 picks per cm (51 ends per in. x 55 picks per in.), a basis weight of 264 g/m$^2$ (7.8 oz/yd$^2$), a fabric tightness of 1.13, and a fiber tightness of 1.25. Its Specific Wyzenbeek Abrasion Resistance was 6.3 cycles/g/m2. This fabric, which had a fiber content of 51%/49% PPD-T/MPD-I fibers, had a smooth, supple, relatively soft hand with good wrinkle recovery. The fiber content of the finished fabric was the same as the fiber content of the greige fabric.

A greige plain-weave fabric of 100% PPD-T fibers made in the same way as the greige plain-weave fabric of Example 3 and having the same basis weight and construction had a Specific Wyzenbeek Abrasion Resistance of only 2.3 cycles/g/m$^2$. It had a stiff, harsh hand, much harsher than the finished fabric of Example 3. When it was wrinkled it had almost no recovery.

Example 4

Similar to Example 1, a flame-retarding swelling agent was employed to treat a plain-weave fabric woven from a yarn spun from a two-component intimate blend of 50 wt. % PPD-T staple fibers and 50 wt. % pima cotton, except that a ring spun yarn was used in place of the yarn made on a air-jet open end spinning machine.

A picker blend sliver of 50 wt. % of the same PPD-T fibers used in Example 1 and 50 wt. % pima cotton having a fiber length of 3.65 cm (1-7/16 in.) was prepared and processed by the conventional cotton system into a spun yarn having 7.1 tpc (18 tpi) of "Z" twist using a ring spinning frame. The yarn so made was "S" ply-twisted 4.3 tpc (11 tpi) to make a two-ply spun yarn having a linear density of 614 dtex (nominal 20/2 cotton count; 558 denier).

The two-ply spun yarn was woven on a shuttle loom to make a plain-weave fabric. The greige plain-weave fabric had a construction of 19 ends per cm x 21 picks per cm (49 ends per in. x 53 picks per in.), a basis weight of 261 g/m$^2$ (7.7 oz./yd$^2$), a fabric tightness of 1.10 and a fiber tightness of 0.34. Its Specific Wyzenbeek Abrasion Resistance was 2.2 cycles/g/m$^2$.

A quantity of the greige plain-weave fabric as taken from the loom (unwashed) was scoured, dyed, treated with a flame-retarding swelling agent, cured with gaseous ammonia, rinsed, dried, and subjected to a conventional commercial compressive shrinkage treatment as in Example 1 above. This treatment was carried out in a manner such that the pick-up of the THPC: urea condensate was 20 wt. % on the weight of the cotton in the 50% PPD-T/50% cotton fabric. After this treatment, the fabric had a fiber content of 45 wt. % PPD-T staple fibers and 55 wt. % flame-retarded cotton fibers.

The finished (flame-retarded, compressively shrunk) fabric had a construction of 20 ends per cm x 21 picks per cm (50 ends per in. x 53 picks per in.), a basis weight of 301 g/m$^2$ (8.9 oz/yd$^2$), a fabric tightness of 1.13, and a fiber tightness of 2.90. Its Specific Wyzenbeek Abrasion Resistance was 21.4 cycles/g/m$^2$. The finished fabric had aesthetics very similar to the fabric of the invention of Example 1.

A greige plain-weave fabric of 100% PPD-T fibers made in the same way as the greige plain-weave fabric of this Example 4 and having the same basis weight and construction had a Specific Wyzenbeek Abrasion Resistance of only 3.2 cycles/g/m$^2$. It had a stiff, harsh hand.

Example 5

Similar to Example 4, a flame-retarding swelling agent was employed to treat a plain-weave fabric woven from a ring spun yarn, except that the yarn was made from a sliver of a two-component intimate blend of 25 wt. % PPD-T staple fiber and 75 wt. % pima cotton.

The procedure of Example 4 was repeated, except that a sliver of a picker blend of 25 wt. % of the same PPD-T staple fibers and 75 wt. % of the same pima cotton was used to make a two-ply ring-spun yarn having the same amount of "Z" twist and "S" ply-twist. The yarn had a linear density of 649 dtex (nominal 18/2 cotton count; 590 denier).

The two-ply spun yarn was woven on a shuttle loom to make a plain-weave fabric. The greige plain-weave fabric had a construction of 19 ends per cm x 18.5 picks per cm (49 ends per in. x 47 picks per in.), a basis weight of 275 g/m$^2$ (8.1 oz./yd$^2$), a fabric tightness of 1.06 and a fiber tightness of 0.29. Its Specific Wyzenbeek Abrasion Resistance was 1.05 cycles/g/m$^2$.

A finished (flame-retarded, compressively shrunk) fabric was then prepared as in Example 4. The treatment was carried out in a manner such that the pick-up of the THPC: urea condensate was 20 wt. % on the weight of the cotton in the 25% PPD-T/75% cotton fabric. After this treatment, the fabric had a fiber content of 22 wt. % PPD-T staple fibers and 78 wt. % flame-retarded cotton fibers. The finished fabric had a construction of 20 ends per cm x 18.5 picks per cm (51 ends per in. x 47 picks per in.), a basis weight of 301 g/m$^2$ (8.9 oz/yd$^2$), a fabric tightness of 1.13, and a fiber tightness of 1.25. Its Specific Wyzenbeek Abrasion Resistance was 5.3 cycles/g/m$^2$. The finished fabric had aesthetics very similar to a flame-retarded all-cotton fabric of similar construction and basis weight.

Example 6

Similar to Example 1, a flame-retarding swelling agent was employed to treat a plain-weave fabric woven from a yarn spun on an air-jet open end spinning machine, except that the yarn was a compound spun yarn of 58 wt. % PPD-T staple fibers and 42 wt. % pima cotton made in two passes through the machine.

A 2.5 g/m (35 grain/yd) sliver of PPD-T fibers was first formed and spun into yarn on an air-jet open end spinning machine by the same method described in Example 3 to form a 155 dtex (38 cotton count) 100% PPD-T spun yarn. The PPD-T spun yarn made in the first pass was then used as the core yarn to form a compound yarn by passing it through the air-jet open end spinning machine again and joining it with a 3.9 g/m (55 grains/yd) sliver of pima cotton having a fiber length of 3.65 cm (1-7/16 in.) to form a compound singles yarn. The machine settings for both the first and second passes are listed in Table 2. The compound singles yarn so formed had a linear density of 245 dtex and was a sheath/core yarn having a fasciated structure in which some of the fibers in the PPD-T core yarn were wrapped by other PPD-T fibers and some of the cotton fibers in the sheath also wrapped the PPD-T core yarn. The compound singles yarn was then plied to make a two-ply spun yarn having 3.0 tpc (7.5 tpi) of "S" twist having a linear density of 530 dtex (nominal 22/2 cotton count; 482 denier).

The two-ply spun yarn was woven on a shuttle loom to make a plain-weave fabric. The greige fabric had a construction of 20 ends per cm x 19 picks per cm (52 ends per in. x 49 picks per in.), a basis weight of 234 g/m$^2$ (6.9 oz./yd$^2$), a fabric tightness of 1.07 and a fiber tightness factor of 0.33. Its Specific Wyzenbeek Abrasion Resistance was 3.3 cycles/g/m$^2$.

A quantity of the greige plain-weave fabric as taken from the loom (unwashed) was scoured, dyed, treated with a flame-retarding swelling agent, cured with gaseous ammonia, rinsed, dried, and subjected to a conventional commercial compressive shrinkage treatment as in Example 1 above. This treatment was carried out in a manner such that the pick-up of the THPC: urea condensate was 20 wt. % based on the weight of the cotton in the 58% PPD-T/42% cotton fabric. After this treatment, the fabric had a fiber content of 53 wt. % PPD-T staple fibers and 47 wt. % flame-retarded cotton fibers.

The finished (flame-retarded, compressively shrunk) fabric had a construction of 21 ends per cm x 19 picks per cm (52 ends per in. x 48 picks per in.), a basis weight of 247 g/m$^2$ (7.3 oz/yd$^2$), a fabric tightness of 1.05, and a fiber tightness of 2.14. Its Specific Wyzenbeek Abrasion Resistance was 8.3 cycles/g/m$^2$.

The finished fabric had a rather soft hand, although it was somewhat harsher than the hand of the fabric of Example 5. In general the higher the percentage of PPD-T fibers, the greater the stiffness, the harsher the hand, and the poorer the wrinkle recovery.

Example 7

A highly durable fabric of the present invention was prepared by employing a flame-retarding swelling agent to treat a twill fabric woven from a compound spun warp yarn of 50 wt. % PPD-T staple fibers and 50% pima cotton, made on an air-jet open end spinning machine in two passes through the machine, and an all-cotton fill yarn.

Similar to Ex. 6, a 2.5 g/m (35 grain/yd) sliver of PPD-T fibers was first formed and spun into yarn on an air-jet open end spinning machine to form a 153 dtex (38 cotton count) 100% PPD-T spun yarn. The PPD-T spun yarn made in the first pass was then used as the core yarn to form a compound yarn by passing it through the air-jet open end spinning machine again and joining it with a 2.5 g/m (35 grains/yd) sliver of pima cotton having a fiber length of 3.65 cm (1-7/16 in.) to form a compound singles yarn which was a sheath/core yarn having a fasciated structure similar to the yarn of Ex. 6. The machine settings for both the first and second passes are listed in Table 2. The compound singles yarn was then plied to make a two-ply spun yarn having 3 tpc (7.5 tpi) of "S" twist having a linear density of 617 dtex (nominal 19/2 cotton count; 561 denier).

The plied yarn so formed was used as the warp on a shuttle loom in a 3×1 twill construction with a 4.3 tpc (11 tpi) singles "Z"-twist ring-spun 100% pima cotton yarn having a linear density of 820 dtex (nominal 7/1 cotton count; 745 denier) used in the fill to weave a twill fabric. The greige twill fabric had a construction of 30 ends per cm x 20 picks per cm (76 ends per in. x 50 picks per in.), a basis weight of 400 g/m$^2$ (11.8 oz./yd$^2$), a fabric tightness of 1.08 and a fiber tightness of 0.77. The fabric had a fiber content of 28 wt. % PPD-T staple fibers and 72 wt. % cotton. Its Specific Wyzenbeek Abrasion Resistance values were 3.1 LF and 0.9 SF cycles/g/m$^2$, respectively.

A quantity of the greige twill fabric as taken from the loom (unwashed) was scoured, dyed, treated with a flame-retarding swelling agent, cured with gaseous ammonia, rinsed, dried, and subjected to a conventional commercial compressive shrinkage treatment as in Example 1 above. This treatment was carried out in a manner such that the pick-up of the THPC: urea condensate was 20 wt. % based on the weight of the cotton in the 28% PPD-T/72% cotton fabric. After this treatment, the fabric had a fiber content of 23 wt. % PPD-T staple fibers and 77 wt. % flame-retarded cotton fibers. In the warp yarns, the corresponding percentages were 45 wt. % and 55 wt. %.

The finished (flame-retarded, compressively shrunk) twill fabric had a construction of 29 ends per cm x 20 picks per cm (74 ends per in. x 50 picks per in.), a basis weight of 447 g/m$^2$ (13.2 oz/yd$^2$), a fabric tightness of 1.09, and a fiber tightness of 2.06. Its Specific Wyzenbeek Abrasion Resistance was 7.8 LF and 18.7 SF cycles/g/m$^2$, respectively.

The finished fabric had the fabric flexibility, wrinkle recovery, and a soft hand approaching that of an all-cotton fabric.

Example 8

A highly durable fabric of the present invention was prepared by employing a flame-retarding swelling agent to treat a sateen fabric woven from a compound spun warp yarn of 50 wt. % PPD-T staple fibers and 50% pima cotton, made on an air-jet open end spinning machine in two passes through the machine, and an all-cotton fill yarn.

A quantity of the two-ply spun yarn used to weave the twill fabric of Example 7 was also used as the warp to weave the sateen fabric, the fill yarns being two-ply 7 tpc (18 tpi) "Z"-twist ring spun 100% pima cotton yarns having a linear density of 567 dtex (nominal 20/2 cotton count; 515 denier). The fabric had a fiber content of 30 wt. % PPD-T staple fibers and 70 wt. % cotton. The greige sateen fabric had a construction of 35 ends per cm x 24 picks per cm (88 ends per in. x 60 picks per in.), a basis weight of 413 g/m$^2$ (12.2 oz./yd$^2$), a fabric tightness of 1.13 and a fiber tightness of 0.94. Its Specific Wyzenbeek Abrasion Resistance values were 3.3 LF and 0.97 SF cycles/g/m$^2$, respectively.

A finished (flame-retarded, compressively shrunk) sateen fabric was then prepared using the same procedure used to make the finished twill fabric of Example 7 from its corresponding greige fabric. The treatment was carried out in a manner such that the pick-up of the THPC: urea condensate was 20 wt. % based on the weight of the cotton in the 30% PPD-T/70% cotton fabric. After this treatment, the fabric had a fiber content of 27 wt. % PPD-T staple fibers and 73 wt. % flame-retarded cotton fibers. In the warp yarns, the corresponding percentages were 45 wt. % and 55 wt. %. The finished fabric had a construction of 34 ends per cm x 24 picks per cm (86 ends per in. x 60 picks per in.), a basis weight of 437 g/m$^2$ (12.9 oz/yd$^2$), a fabric tightness of 1.13, and a fiber tightness of 2.48. Its Specific Wyzenbeek Abrasion Resistance values were 14.5 LF and 11.2 SF cycles/g/m$^2$, respectively.

The finished fabric had the fabric flexibility, wrinkle recovery, and a soft hand approaching that of an all-cotton fabric.

Example 9

Similar to Example 7, a flame-retarding swelling agent was employed to treat a twill fabric woven from a warp yarn of 50 wt. % PPD-T staple fibers and 50% cotton and an all-cotton fill yarn, except that the warp yarn was a ring spun yarn made from a sliver of a two-component intimate blend of the PPD-T fibers with combed cotton.

A picker blend sliver of 50 wt. % of the same PPD-T fibers used in Example 1 and 50 wt. % combed cotton having a fiber length of 3 cm (1-3/16 in.) was prepared and processed by the conventional cotton system into a spun yarn having 4.7 tpc of "Z" twist (12 tpi), using a ring spinning frame. The yarn so made was a 516 dtex (nominal 11/1 cotton count; 479 denier) singles spun yarn.

The singles yarn so formed was used as the warp on a shuttle loom in a 3×1 twill construction with a singles 3.9 tpc (10 tpi) "Z"-twist ring-spun 100% carded cotton (average fiber length 2.7 cm or 1-1/16 in.) yarn having a linear density of 837 dtex (nominal 7/1 cotton count, 761 denier) used in the fill to weave a twill fabric. The greige twill fabric had a fiber content of 29 wt. % PPD-T staple fibers and 71 wt. % cotton. It had a construction of 33 ends per cm x 19 picks per cm (85 ends per in x 49 picks per in), a basis weight of 404 g/m$^2$ (11.9 oz./yd$^2$), a fabric tightness of 1.11 and a fiber tightness of 0.77. Its Specific Wyzenbeek Abrasion Resistance values were 0.8 LF and 0.7 cycles/g/m$^2$, respectively.

A finished (flame-retarded, compressively shrunk) twill fabric was then prepared using the same procedure used to make the finished twill fabric of Example 7 from its corresponding greige fabric. The treatment was carried out in a manner such that the pick-up of the THPC: urea condensate was 20 wt. % based on the weight of the cotton in the 29% PPD-T/71% cotton fabric. After this treatment, the fabric had a fiber content of 25 wt. PPD-T staple fibers and 75 wt. % flame-retarded cotton fibers. In the warp yarns, the corresponding percentages were 45 wt. % and 55 wt. %. The finished fabric had a construction of 33 ends per cm x 20 picks per cm (83 ends per in. x 50 picks per in.), a basis weight of 437 g/m$^2$ (12.9 oz/yd$^2$), a fabric tightness of 1.1, and a fiber tightness of 1.31. Its Specific Wyzenbeek Abrasion Resistance values were 5.1 LF and 8.5 SF cycles/g/m$^2$, respectively.

After the finished 25% PPD-T/75% cotton fabric had been laundered once, the fabric had the dry, pleasant feel of an all-cotton fabric and approached an all-cotton fabric in softness, wrinkle recovery, and flexibility.

Example 10

A highly wear resistant fabric of the present invention was prepared by multiple cycles of exposure to agitation in hot demineralized water followed by drying in hot air of a 3×1 twill fabric of a sheath/core yarn of 40 wt. % PPD-T staple fibers and 60 wt. % combed cotton made on a friction spinning machine.

A 3.2 g/m (45 grains/yd) sliver of the same PPD-T fibers used in Example 1 was fed axially at 0.8 m/min. between the rotating rolls of friction spinning machine (DREF 3 Spinning Machine Model No. 3E3000604 manufactured by the Fehrer Machine Co., Linz, Austria in 1983). Five 2.5 g/m (35 grains/yd) slivers of combed cotton having a fiber length of 3 cm (1-3/16 in.) were simultaneously fed perpendicularly to the sliver of PPD-T fibers at 0.315 m/min. between the nip region of the two spinning drums rotating at 2000 revolutions per min. A 649 dtex (nominal 9/1 cotton count; 590 denier) yarn with a 40 wt. % PPD-T core and a 60 wt. % combed cotton sheath was drawn off at 110 m/min. The yarn so formed was used as the warp on a shuttle loom in a 3×1 twill construction with a 3.9 tpc (10 tpi) singles twist ring spun 100% combed cotton yarn having a linear density of 836 dtex (7.0/1 nominal cotton count; 760 denier) used in the fill to weave a twill fabric. The greige fabric had a fiber content of 23 wt. % PPD-T staple fibers and 77 wt. % cotton. It had a construction of 30 ends per cm x 20 picks per cm (76 ends per in x 50 picks per in), a basis weight of 416 g/m$^2$ (12.3 oz./yd$^2$), a fabric tightness of 1.09 and a fiber tightness of 0.86. Its Specific Wyzenbeek Abrasion Resistance values were 3.0 LF and 1.7 SF cycles/g/m$^2$, respectively.

A quantity of the greige twill fabric was subjected to multiple cycles of alternate agitation in 60° C. demineralized water in a conventional home washer and drying in a conventional home dryer. The finished fabric, which had been subjected to 25 cycles of agitation in the demineralized water and drying, had a construction of 30 ends per cm x 20 picks per cm (75 ends per in. x 51 picks per in.), a basis weight of 420 g/m$^2$ (12.4 oz/yd$^2$), a fabric tightness of 1.10, and a fiber tightness of 1.37. Its Specific Wyzenbeek Abrasion Resistance values were 8.2 LF and 2.0 SF cycles/g/m$^2$, respectively. The finished fabric had the appearance of an all cotton fabric, since the wrapped PPD-T was difficult to detect, and had a hand and wrinkle recovery similar to an all cotton fabric. The fiber content of the finished fabric was the same as the fiber content of the greige fabric.

Example 11

Similar to Example 2, a double mercerizing treatment was employed to treat a twill fabric woven from ring spun yarns, except that the warp yarn was made from a sliver of a two-component intimate blend of 35 wt. % PPD-T staple fibers and 65 wt. % cotton and the fill yarn was an all-cotton yarn.

A picker blend sliver of 35 wt. % of the blue dyed PPD-T fibers of Example 2 and 65 wt. % of the combed cotton of Example 2) was prepared and processed by the conventional cotton system into a spun yarn having 3.8 tpc of "Z" twist (9.7 tpi) using a ring spinning frame. The yarn so made was 971 dtex (nominal 6/1 cotton count; 883 denier) singles spun yarn.

The singles yarn so formed was used as the warp on a shuttle loom in a 3×1 right hand twill construction with a singles ring spun 100% combed cotton fill yarn having the same twist and linear density. The greige twill fabric had a construction of 22 ends per cm x 18 ends per cm (62 ends per in. x 50 picks per cm), a basis weight of 521 g/m$^2$ (15.4 oz/yd$^2$), a fabric tightness of 1.09, and a fiber tightness of 0.77. The fabric had a fiber content of 20 wt. % PPD-T staple fiber and 80 wt. % cotton. Its Specific Wyzenbeek Abrasion Resistance values were 1.3 LF and 1.9 SF cycles/g/m$^2$.

A quantity of the greige twill fabric prepared as described above, as taken from the loom (unwashed), had a width of 132 cm (52 in.) It was scoured in hot water and dried under low tension on a tenter frame to a width of 124 cm (49 in). It was then held relaxed at a width of 122 cm (48 in.) and mercerized by subjecting it to a 24% sodium hydroxide solution at 82° C. (180° F.) for about 30 seconds, rinsed in water, neutralized, and dried on hot cans. It was then compressive shrunk. Mercerization was repeated with the sample held at a width of 114 cm (45 in.) width. It was then dyed blue on a continuous range and dried at 82°-3° C. (180°-2° F.) on hot cans. Following dyeing it was again compressive shrunk. The basis weight for this double mercerized, compressively shrunk fabric was 480 g/m$^2$ (14.2 oz/yd$^2$ ). It had a construction of 25 ends per cm x 18 picks per cm (63 ends per in x 46 picks per in.), a fabric tightness of 1.09, and a fiber tightness of 1.26. It had a fiber content of 20 wt. % PPD-T staple fiber and 80 wt. % cotton. In the warp yarns, the corresponding percentages were 35 wt. % and 65 wt. %. Its Specific Wyzenbeek Abrasion Resistance values were 4.0 LF and 3.4 SF cycles/g/m$^2$.

Example 12

Example 2 was repeated, except that the picker a blend sliver was made of 15 wt. % of the blue dyed PPD-T fibers, 20 wt. % of the 6,6-nylon fibers, and 65 wt. % of the combed cotton, the yarn so made being a singles spun yarn of the same twist and linear density of the yarn of Example 2.

As in Example 2, the singles yarn so formed was used as the warp on a shuttle loom in a 3×1 twill construction with a singles ring spun fill yarn made from 30 wt. % of the 6,6-nylon fibers and 70 wt. % combed cotton, the fill yarn having the same twist and linear density as the warp yarn; however, both a right hand and a left twill fabric (otherwise identical) were woven. The left hand twill fabric was accordingly a fabric in which the twill yarn had a twist counter to the twill direction. In the Tables these fabrics are designated as 12R and 12L, respectively. These fabrics had a fiber content of 9 wt. % PPD-T staple fibers, 24 wt. % nylon staple fibers, and 67 wt. % cotton fibers. The initial right hand twill fabric had a construction of 24.4 ends per cm x 17.3 picks per cm (62 ends per in x 44 picks per in.), a basis weight of 505 g/m$^2$ (14.9 oz/yd$^2$), a fabric tightness of 1.10, and a fiber tightness of 0.74. Its Specific Wyzenbeek Abrasion Resistance values were 1.0 LF and 1.2 SF cycles/g/m$^2$. The corresponding values for the initial left hand twill fabric were not determined.

As in Example 2, each of these unwashed greige twill fabrics, which were 131 cm (51.75 in ) wide, were scoured in hot water, dried under low tension on a tenter frame, held relaxed at a width of 122 cm (48 in.), mercerized by subjecting them to a 24% sodium hydroxide solution at 82° C. (180° F.) for about 30 seconds, rinsed in water, neutralized, and dried on hot cans. Mercerization was repeated with the fabrics held at a width of 114 cm (45 in.) width. They were then dyed blue on a continuous range and dried at 82° C. (180° F.) on hot cans. Following dyeing they were compressive shrunk. The basis weight for the finished (double mercerized, compressively shrunk fabrics) was 460 gm/m$^2$ (13.6 oz/yd$^2$) and 471 gm/m$^2$ (13.9 oz/yd$^2$) for the left and right hand twill fabrics, respectively. The finished fabrics had a fiber content of 9 wt. % PPD-T staple fibers, 24 wt. % nylon staple fibers, and 67 wt. % cotton fibers. In the warp yarns, the corresponding percentages were 15 wt. %, 20 wt. % and 65 wt. %.

The finished right hand twill fabric had a construction of 25 ends per cm x 17 picks per cm (63 ends per in x 43 picks per in.), a fabric tightness of 1.11, and a fiber tightness of 1.08. Its Specific Wyzenbeek Abrasion Resistance values were 2.3 LF and 3.1 SF cycles/g/m$^2$.

The finished left hand twill fabric had a construction of 25 ends per cm x 17 picks per cm (63 ends per in x 44 picks per in.), a fabric tightness of 1.11, and a fiber tightness of 1.03. Its Specific Wyzenbeek Abrasion Resistance values were 3.3 LF and 2.3 SF cycles/g/m$^2$.

The results from the above Examples are summarized in Table 1, in which "Low-Mod", "LF", and "SF" are abbreviations for "Low-Modulus", "Long Float", and "Short Float", respectively. In the table, the ratio of PPD-T fibers to low modulus fibers is shown for the warp yarn and the same ratio applies to the fabric when the fill yarn is the same as the warp yarn. A separate ratio for the fabric is shown parenthetically when the fill yarn differs from the warp yarn.

TABLE 1

FABRICS OF THE INVENTION

| Ex. No. | Low-Mod Staple Fiber(s) | PPD-T:Low-Mod Ratio WARP (FABRIC) | Fabric Tightness | Fiber Tightness | Spec. Abras. Resist., Cycles/g/m$^2$ |
|---|---|---|---|---|---|
| 1 | Cotton | 45:55 | 1.18 | 6.67 | 27.6 |
| 2 | Nylon/ Cotton | 25:20/55 (15:24/61) | 1.10 | 1.34 | 4.4 LF 4.4 SF |
| 3 | MPD-I | 51:49 | 1.13 | 1.25 | 6.3 |
| 4 | Cotton | 45:55 | 1.13 | 2.90 | 21.4 |
| 5 | Cotton | 22:78 | 1.13 | 1.25 | 5.3 |
| 6 | Cotton | 53:47 | 1.05 | 2.14 | 8.3 |
| 7 | Cotton | 45:55 (23:77) | 1.09 | 2.06 | 7.8 LF 18.7 SF |
| 8 | Cotton | 45:55 (27:73) | 1.13 | 2.48 | 14.5 LF 11.2 SF |
| 9 | Cotton | 45:55 (25:75) | 1.11 | 1.31 | 5.1 LF 8.5 SF |
| 10 | Cotton | 40:60 (23:77) | 1.10 | 1.37 | 8.2 LF 2.0 SF |
| 11 | Cotton | 35:65 (20:80) | 1.09 | 1.26 | 4.0 LF 3.4 SF |
| 12R | Nylon/ Cotton | 15:20/65 (9:24/67) | 1.11 | 1.08 | 2.3 LF 3.1 SF |
| 12L | Nylon/ Cotton | 15:20/65 (9:24/67) | 1.11 | 1.03 | 3.3 LF 2.3 SF |

TABLE 2

AIR-JET OPEN END SPINNING MACHINE SETTINGS

| | Example No. | | | |
|---|---|---|---|---|
| | 1 | 3 C/S | 6 C/S | 7 C/S |
| Sliver wt. g/m | 2.5 | 2.5/2.5 | 2.5/3.9 | 2.5/2.5 |
| Speed m/min. | 160 | 160/160 | 140/140 | 160/160 |
| Total Draft Ratio | 95 | 158/181 | 164/265 | 150/175 |
| Main Draft Ratio | 35 | 35/35 | 35/35 | 35/35 |
| Feed Ratio | .98 | .99/.99 | .97/97 | .99/.99 |
| Condenser, mm | 4 | 3/3 | 4/4 | 3/3 |
| Distance-roll to jet, mm | 39 | 39/39 | 39/39 | 39/39 |
| Air Pressure kg/cm$^2$ | | | | |
| Nozzle 1 | 3.5 | 4/4 | 3/3 | 3/3 |
| Nozzle 2 | 4 | 4/4 | 4/4 | 4/4 |

Note: C/S = core/sheath

I claim:

1. A highly durable woven fabric made from yarns of discrete staple fibers having good textile aesthetics comprising 8-70% high modulus organic staple fibers having a modulus of greater than 200 g/dtex and a linear density of less than 10 decitex per fiber and 30-92% low modulus organic staple fibers having a modulus of less than 100 g/dtex and a linear density of less than 10 decitex per fiber and the fabric having a Specific Wyzenbeek Abrasion Resistance on at least one face of the fabric at least 25% greater than the Specific Wyzenbeek Abrasion Resistance on the same face of a greige fabric of the same basis weight and construction made from 100% of the high modulus staple fibers, the warp yarns of said fabric containing at least 15% of the high modulus organic staple fibers and at least 30% of the low modulus organic staple fibers.

2. The fabric of claim 1 wherein the low modulus staple fibers have been shrunk to the point where they lock the high modulus staple fibers in place such that the fabric has a Specific Wyzenbeek Abrasion Resistance on at least one face of the fabric at least 25% greater than the Specific Wyzenbeek Abrasion Resistance on the same face of a greige fabric of the same basis weight and construction made from 100% of the high modulus staple fibers.

3. A highly durable woven fabric made from yarns of discrete staple fibers having good textile aesthetics comprising 8–70% high modulus organic staple fibers having a modulus of greater than 200 g/dtex and a linera density of less than 10 decitex per fiber and 30–92% low modulus organic staple fibers having a modulus of less than 100 g/dtex and a linear density of less than 10 decitex per fiber and the fabric having a Specific Wyzenbeek Abrasion Resistance on at least one face of the fabric of greater than 5 cycles g/m$^2$, the warp yarns of said fabric containing at least 15% of the high modulus organic staple fibers and at least 30% of the low modulus organic staple fibers.

4. The fabric of claim 3 wherein the low modulus staple fibers have been shrunk to the point where they lock the high modulus staple fibers in place such that the fabric has a Specific Wyzenbeek Abrasion Resistance on at least one face of the fabric of greater than 5 cycles/g/m$^2$.

5. A fabric as in one of claims 1–4 wherein the low modulus and the high modulus fibers are crimped.

6. The fabric of claim 2 wherein the fabric has a Specific Wyzenbeek Abrasion Resistance one each face of the fabric at least 25% greater than the Specific Wyzenbeek Abrasion Resistance on either face of a greige fabric of the same basis weight and construction made from 100% of the high modulus fibers.

7. The fabric of claim 4 wherein the fabric has a Specific Wyzenbeek Abrasion Resistance on both faces of the fabric of greater than 5 cycles/g/m$^2$.

8. A highly durable woven fabric made from yarns of discrete staple fibers and having good textile aesthetics comprising 8–70% high modulus organic staple fibers having a modulus greater than 200 g/dtex and 30–92% of low modulus organic staple fibers having a modulus of less than 100 g/dtex, the warp yarns of said fabric containing at least 15% of the high modulus organic fibers and at least 30% of the low modulus fibers, said fabric having a fabric tightness greater than 1.0 and a fiber tightness greater than 1.0.

9. A fabric as in one of claims 1, 3 or 8 wherein the staple fibers have a linear density of from about 1 to about 3 decitex per fiber.

10. A fabric according to claims 1, 3 or 8 wherein the yarns in the warp direction in the woven fabric are yarns comprised of both high modulus staple fibers and low modulus staple fibers and the yarns in the fill direction in the woven fabric are comprised of low modulus staple fibers only.

11. A fabric according to claim 10 wherein the yarns in the fill direction are comprised of cotton.

12. A fabric according to claims 1, 3 or 8 wherein the low modulus fiber is cotton.

13. The fabric of claim 12 in which the high modulus fiber is flame resistant and the cotton is flame-retarded.

14. The fabric of claims 1–13 in which additives incorporated in the fabric are in the range of 0–5 wt. % of the weight of the fabric.

15. A fabric according to claim 8 in which the yarn is comprised of an intimate blend of crimped staple fibers.

16. A fabric according to claim 8 in which the warp yarn is a sheath/core yarn of crimped staple fibers in which the high modulus fibers form the core and are locked in place by low modulus synthetic fibers comprising the sheath.

17. A fabric according to claims 1, 3 or 8 wherein the high modulus fiber is poly(p-phenylene terephthalamide) fiber.

18. A fabric of claims 1, 3 or 8 wherein the high modulus staple fiber is poly(p-phenylene terephthalamide) and the low modulus staple fiber is cotton.

19. A fabric according to claims 1, 3 or 8 wherein the low modulus fiber is a synthetic fiber.

20. A fabric according to claims 1, 3 or 8 wherein the low modulus fiber is a mixture of cotton and synthetic fiber.

21. A fabric according to claims 1, 3 or 8 wherein the fabric is a twill fabric in which the twist of the warp yarn is counter to the twill direction of the fabric.

* * * * *